United States Patent [19]

Langer et al.

[11] Patent Number: 4,628,936

[45] Date of Patent: Dec. 16, 1986

[54] SEGMENTED TRIPLANAR ORTHOPEDIC APPLIANCE

[75] Inventors: Sheldon Langer; Justin Wernick, both of Woodbury; R. Paul Jordan, Whitestone, all of N.Y.

[73] Assignee: The Langer Biomechanics Group, Inc., Deer Park, N.Y.

[21] Appl. No.: 580,250

[22] Filed: Feb. 15, 1984

[51] Int. Cl.[4] ..... A43B 7/16

[52] U.S. Cl. ..... 128/614; 36/31; 36/43; 128/596; 128/615; 128/621

[58] Field of Search ..... 128/80 R, 80 D, 581, 128/586, 590, 596, 614, 615, 621; 36/31, 43, 44, 71, 80, 91, 92

[56] References Cited

U.S. PATENT DOCUMENTS 2,129,424 9/1938 Jay ..... 128/621 X 2,185,526 1/1940 Silver ..... 128/615 X

FOREIGN PATENT DOCUMENTS 639153 6/1950 United Kingdom ..... 128/581

*Primary Examiner*—Edgar S. Burr

*Attorney, Agent, or Firm*—James & Franklin

[57] ABSTRACT

A foot orthosis for correctably realigning and repositioning specific anatomic segments of the human foot consists of three functional components, namely, a heel complex segment and two longitudinal forefoot segments—namely, a medial segment and a lateral segment.

The heel complex segment is independently connected to each longitudinal forefoot segment by a connector. The segments function sufficiently independently from one another to consider the device a triplanar foot orthosis.

22 Claims, 11 Drawing Figures

FIG. 6
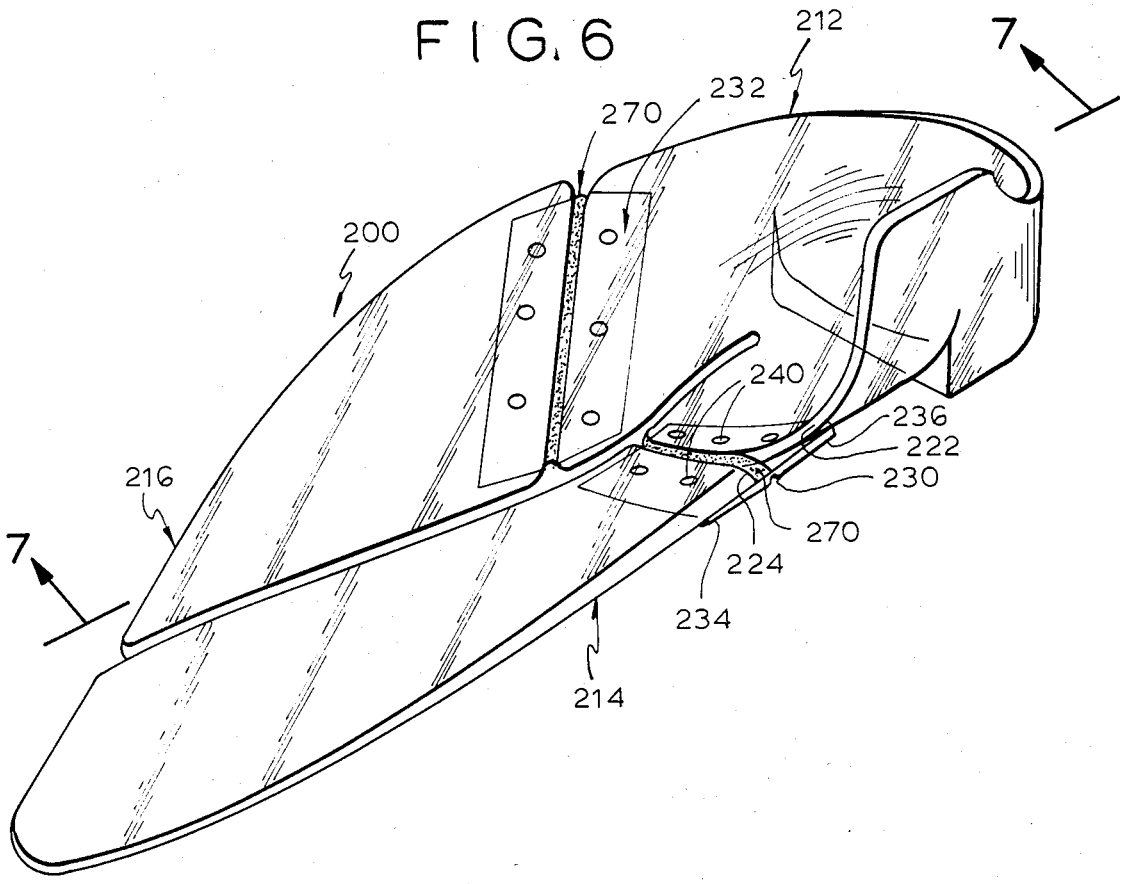
FIG. 7a
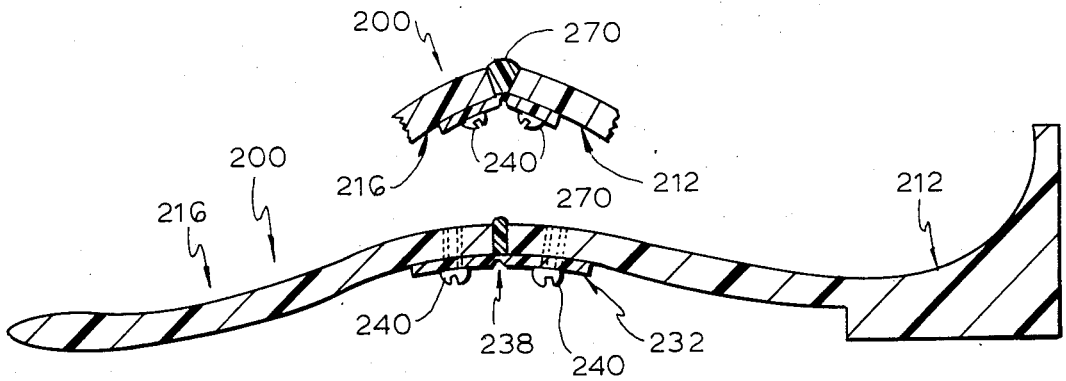
FIG. 7

SEGMENTED TRIPLANAR ORTHOPEDIC APPLIANCE

BACKGROUND OF THE INVENTION

The present invention relates to a foot orthosis and, more particularly, to an orthopedic appliance for correctably realigning and repositioning specific anatomic segments of the human foot.

In describing the motions which can occur within the subtalar and midtarsal joints, it is important to realize that the axis of motion of these two important joints is not perpendicular to any one body plane. Therefore, the resultant motion which occurs is considered a tri-planar or complex motion. The complex motions which occur at the subtalar and midtarsal joints are called pronation and supination.

Subtalar joint pronation is a complex triplanar motion which essentially will "unlock" the bones of the foot and render the foot loose and mobile. This feature is particularly useful at heel strike so that the foot can effectively adapt to the supporting surface. As the foot pronates, the calcaneus or heel bone everts and the talus above adducts and plantarflexes. This is also accompanied by an internal rotation of the lower extremity. Pronation of the subtalar joint is a necessity since by permitting this motion between these two bones, thus facilitating flexion of the knee above, it becomes a very effective attenuator of the impact shock which can be as high as 2.5 times body weight.

Supination, on the other hand, is the opposite of pronation. It is essentially a motion that "locks" the various bones of the foot together in order to convert our "loose mobile bag of bones", so to speak, into a more rigid lever in preparation for the transfer of body weight distally toward the toes. The motion consists of an inversion of the calcaneus and abduction and dorsiflexion of the talus and an external rotation of the lower extremity, thus facilitating extension of the knee.

Pronation in and of itself is a very healthy and necessary motion to permit a gait which is both efficient and low in impact shock. It is when this pronatory motion is abnormally prolonged or excessive that problems develop both within the foot and more proximally in other body joints, i.e., ankle, knee, and hip.

By comparison, the midtarsal joint, which determines and/or permits movement of the forefoot on the rearfoot, functions around two axes of motion; a longitudinal axis and an oblique axis. The longitudinal axis permits primarily inversion and eversion of the forefoot; while the oblique axis allows primarily abduction and dorsiflexion of the forefoot or a combination of adduction and plantarflexion of the forefoot on the rearfoot. The two axes function not only concurrently to permit a pronatory/supinatory motion of the forefoot to take place but also separately to permit clinically observable independent oblique or longitudinal axis motion to take place.

If the forces which are entering the feet are abnormal, excessive, misdirected or mal-phasic, the ability of the foot to perform its function segmentally and sequentially will be disturbed. Previous therapeutic or assistive approaches have failed to address the combination of factors affecting foot function. While biomechanical or functional foot orthoses attempted this, their "unibody" construction actually intensified some of the problems:

1. By causing lifting of the lateral column of the foot in mid-stance phase, thus, making the longitudinal joint-to-ground angle more acute and destabilizing the lateral column.

2. By preventing the medial column from lowering itself sufficiently to achieve its adaptive function or by allowing the medial column to lower too much, thus preventing the phasic restoration of the medial column position.

3. By tilting the forefoot position too much or too little in a varus or valgus position (i.e., fixed inversion or fixed eversion position), thereby allowing forefoot orthotic corrections which should function in midstance and/or propulsive phase to influence and disrupt the function of the rearfoot in the earlier occurring contact phase.

4. By the inability of the orthoses because of the "unibody" construction to adapt to the changing positions, lengths and widths of the foot occurring because of dynamic function.

5. By preventing the first ray from functioning independently from the lesser metatarsals and/or preventing the lesser metatarsals from functioning independently from the first ray complex.

6. By essentially ignoring the all-important oblique axis of the midtarsal joint, thus disallowing any stabilization of the lateral and, therefore, medial columns of the foot during the propulsive phases of gait. Thus, single, continuous non-segmented, biomechanical foot orthoses which attempt to supply control primarily on the frontal plane are incapable of adjusting to the changing functional positions of the various foot segments as they go through their phasic structural and muscular repositioning in an attempt to achieve their normal stabilization and propulsion. Other foot orthotic devices which attempted stabilization failed to address the aspects of muscular force vectors, angular osseous relationships, the subtalar joint axis, the longitudinal and oblique axes of the midtarsal joint, and the tri-plane motions involved with corresponding phasic muscle activities.

Accordingly, it is an object of the present invention to provide a foot orthosis which is capable of adjusting to the varying positions and activities of the human foot in a manner which maximizes the body's own muscular, neurologic and skeletal functions.

Another object is to provide such a foot orthosis which is able to mobilize, restrict or enhance certain motions by altering the angular relationships of the osseous structures of the feet which, together with phasic muscle activity, are responsible for the unlocking and locking (adaptive and propulsive) mechanisms in the feet.

A further object is to provide such a foot orthosis which permits control of the degree of positional change in a sequential manner.

It is also an object to provide such a foot orthosis comprised of components modularly assemblable to meet the particular needs of a given patient.

SUMMARY OF THE INVENTION

It has now been found that the above and related objects of the present invention are obtained in a segmented triplanar orthopedic appliance for correctably realigning and repositioning specific anatomical segments of the human foot comprising three independently pivotable substantially rigid segments: a heel segment, medial segment, and lateral segment. The heel segment is adapted to lie generally underneath the plantar aspect of the heel region of the foot, the medial segment is adapted to extend longitudinally lengthwise of the foot and lie generally underneath the plantar aspect of at least the medial column of the foot, and the lateral segment is adapted to extend longitudinally lengthwise of the foot and lie generally underneath the plantar aspect of at least a portion of the lateral column of the foot. First substantially flexible means operatively connect the heel segment and the medial segment, while second substantially flexible means operatively connect the heel segment and the lateral segment, thereby permitting independent limited pivoting of the medial and lateral segments, respectively, relative to the heel segment.

Typically the opposing faces of the medial and lateral segments are spaced from each other along a curve adapted to lie parallel to and in a plane beneath the longitudinal axis of the midtarsal joint, the opposing faces of the heel and lateral segments are generally spaced from each other along a plane adapted to pass through the cuboid parallel to the oblique axis of the midtarsal joint, and the opposing faces of the heel and medial segments are generally spaced from each other along a plane parallel to the axis of motion of the first ray. The curve between the medial and lateral segments preferably extends between the third and fourth rays. Further, the heel segment is notched along a curve corresponding to the curve passing between the navicular and the cuboid, to the talus.

In the preferred embodiment of the present invention the various connecting means maintain the opposing surface of the heel segment, on the one hand, and the other segments, on the other hand, in close proximity. Means are provided for removably securing opposite ends of the connecting means to the plantar aspects of the heel segments, on the one hand, and one of the other segments, on the other hand. Each of the connecting means preferably comprises a pair of rigid portions foldable about a common crease therebetween.

Resilient biasing means may be provided to bias the lateral segment, and in particular cases the medial segment as well, into a predetermined relationship with the heel segment. The biasing means may take the form of special connecting means operatively secured to the heel segment and one of the other segments, for example, a special second connecting means which resiliently biases the distal end of the lateral segment downwardly below the plane of the heel segment. Alternatively, as part of the connecting means or in addition thereto, the biasing means may comprise a resilient strip (e.g., of a polyurethane derivative) disposed between, and optionally secured to, a pair of facing surfaces of the heel segment and one of the other segments, thereby to bias the distal end of the one other segment to pivot downwardly. Finally, the biasing means may be a spring having one end operatively secured to the heel segment and the other end operatively secured to one of the other segments to bias the one other segment rearwardly, thereby causing the distal end thereof to pivot downwardly.

Preferably the lateral segment extends only to the base of the metatarsals and is movable between first and second positions, the biasing means being adapted to bias the lateral segment from the second position towards the first position. The lateral segment in the first position acts on a common surface with the heel segment to reposition the heel segment for support of the cuboid and in the second position is disposed so as to not effect repositioning of the heel segment. The lateral segment assumes the first position in response to the biasing means during pronation and the second position in response to and during supination.

Posting means may be operatively mounted on the plantar aspects of the heel segment, the lateral segment or elsewhere.

BRIEF DESCRIPTION OF THE DRAWING

FIG. 6 is an isometric view of the third embodiment of the present invention (a left foot orthosis);

FIG. 7 is an elevation section view of the third embodiment, taken along the line 7—7 of FIG. 6, with the lateral hinge being shown unflexed;

FIG. 7*a* is a partial view of the third embodiment similar to FIG. 7, but showing the lateral hinge flexed downwardly;

DETAILED DESCRIPTION OF THE PREFERRED EMBODIMENTS

Figures 1, 2:
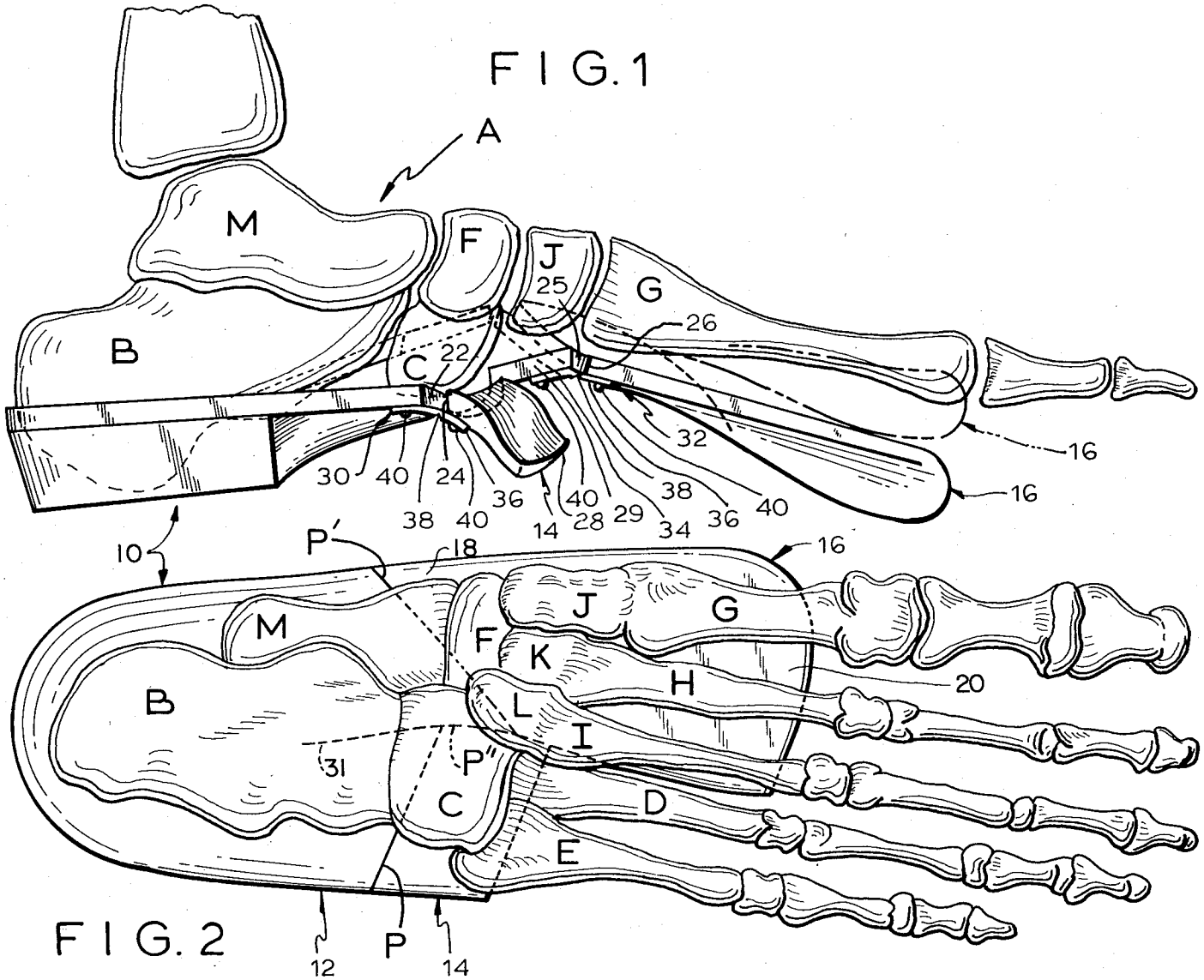
FIG. 1 is a side elevation view of a human foot supported by a first embodiment of the orthopedic appliance of the present invention (a right foot orthosis), with both forefoot segments being shown pivoted downwardly and with the second through fifth metatarsals and associated digits of the foot omitted for illustrative purposes (the medial segment also being illustrated in its elevated position in phantom-line).
FIG. 2 is a top plan view of a human foot supported by the first embodiment.

Referring now to FIGS. 1–2 in particular, therein illustrated is a foot orthosis generally designated by the numeral 10. The foot orthosis 10 (a right foot orthosis being shown) is a segmented triplanar orthopedic appliance for correctively realigning and repositioning specific anatomical segments of a human foot A and is comprised primarily of substantially rigid segments having upper surfaces which can conform to the anatomical contour of the plantar aspects of the foot. The appliance 10 is comprised essentially of three substantially rigid segments as follows: a heel segment generally designated by the numeral 12 (corresponding to the calcaneous 3), a lateral segment generally designated by the numeral 14 (corresponding to the cuboid C and fourth and fifth metatarsal bones D and E), and a medial segment generally designated by the numeral 16 (corresponding to the navicular F, first, second and third metatarsal bones G, H, I and their corresponding cuneiforms J, K, L).

More particularly, the heel or rearfoot complex segment 12 is adapted to lie generally underneath and receive the plantar aspect of the heel B (calcaneus) of the foot. The lateral segment 14 is adapted to extend longitudinally lengthwise of the foot and lie generally underneath and receive the plantar aspect of at least the lateral column of the foot (comprised of the cuboid C and the proximal ends of the fourth and fifth metatarsal bones D and E). The medial segment 16 is comprised of a proximal arch portion 18 and a distal forefoot portion 20. Both of the medial segment portions 18, 20 are adapted to extend longitudinally lengthwise of the foot, and lie generally underneath and receive the plantar aspect of at least a portion of the medial column of the foot (comprised of the navicular F, the first, second and third metatarsal bones G, H, I and their corresponding cuneiforms J, K. L). The medial and lateral segments comprise the forefoot segments.

The opposing faces 22, 24 of the heel and lateral segments 12, 14, respectively, are spaced from each other along a plane P adapted to pass through the cuboid C parallel to the oblique axis of the midtarsal joint. The opposing faces 25, 26 of the heel and medial segments 12, 16, respectively, are spaced from each other along a curve P′ adapted to lie preferably parallel to and in a plane below the longitudinal axis of the midtarsal joint. This longitudinal axis curve passes between the second and third rays, between the second and third cuneiforms K, L, between the navicular F and cuboid C, to the talus M. The curve P″ between the opposing faces 29, 28 of the medial and lateral segments is generally parallel to the proximal portion of the longitudinal axis curve passing between the second and third cuneiforms K, L and between the navicular F and the cuboid C, but may in other embodiments extend more distally between the second and third or third and fourth rays of the foot. Whether the curve P″ between the medial and lateral segments passes between the second and third rays or between the third and fourth rays (as shown) depends upon the width of the lateral segment desired. This in turn corresponds to the relative amount of control the practitioner wishes to exert over the forefoot, the available widths for the orthosis (which may be restricted for women with tight fitting shoes), etc.

As illustrated in FIG. 2, the heel segment is cut through its entire thickness by a notch or curve 31 extending from the distal surface thereof a substantial portion of the distance towards the proximal surface thereof, the curve 31 corresponding substantially to the proximal portion of the longitudinal axis curve passing between the navicular F and the cuboid C, to the talus M.

The heel segment 12 is connected to the lateral segment 14 by means of a first substantially flexible connector, generally designated by the numeral 30, and to the medial segment 16 by a second substantially flexible connector, generally designated by the numeral 32. The connectors 30, 32 maintain the various segments 12, 14, 16 connected to each other at angles and at points that correspond to the angular positions of the subtalar joint and the longitudinal and oblique axes of the midtarsal joint. The connectors 30, 32, also known as hinges, may comprise a pair of rigid or flexible end portions 34, 36 foldable about a common crease 38 therebetween. The proximal end portions 34 of the connectors 30, 32 are secured to the distal portions of the heel segment 12 defining the faces 22, 25, while the distal end portions 36 are secured to the proximal portions of the lateral and medial segments 14, 16 defining the faces 24, 26 respectively. The connector end portions 34, 36 and the various segments 12, 14 and 16 are provided with suitable internally threaded apertures to receive the connecting screws 40. Other secural means, for example, conventional hinges, fasteners, rivets, fitted pegs or even adhesive means of sufficient strength may be employed, in place of the screws 40, to secure the connectors 30, 32 to the segments 12, 14, 16. The connecting means 30, 32 are preferably, although not necessarily, substantially non-stretchable and disposed on the plantar aspects of the segments to maintain the opposing faces 22, 25 of the heel segment 12, on the one hand, and the opposing faces 24, 26 of the other segments 14, 16, on the other hand, in close proximity. Due to such close proximity and the non-stretchable nature of the connecting means 30, 32, the opposing face pairs 22 and 24, 25 and 26 by mutual abutment limit upward pivotal movement of the lateral and medial segments 14 and 16 relative to the heel segment 12.

The connecting means 30, 32 are formed of a high tensile strength, low hysteresis material which resiliently biases the distal end of the lateral segment 14 (and optionally the medial segment 16 as well) downwardly below the general plane of the heel segment 12. The resilient biasing of the connector 30 between the heel segment 12 and the lateral segment 14 increases the force and speed of resupination of the subtalar joint without unduly restricting the ability of the joint to pronate because of excessive support of the arch.

The lateral segment 14 is movable between first and second positions, the bias of the connecting means 30 acting to move the lateral segment from the second position to the first. The lateral segment, and in particular the distal aspect thereof, in the first position acts on a common surface with the heel segment 12 (for example, the sole of a shoe) to reposition and raise the heel segment for support of the cuboid C and in the second position is disposed so as to not effect repositioning of the heel segment. The lateral segment 14 assumes the first position in response to the biasing means during pronation and the second position in response to and during supination.

It will be noted that the medial and lateral segments 16, 14 are not connected to each other, except through the common heel segment 12, so that the connecting means permit independent limited pivoting of these distal forefoot segments relative to the proximal heel segment. This permits the independent activity, and often counteractivity, of the medial and lateral columns in establishing normal adaptive stabilizing and propulsive positions in action.

It will be appreciated that the lateral segment 14 extends not beyond the proximal heads of the fourth and fifth metatarsals D, E. It has been found that such a short lateral segment 14 (as opposed to a longer one) permits a less obtuse angle to be created between the cuboid C and the distal aspects of the calcaneus B, thereby preventing sagittal plane plantarflexory motion (i.e., sag) of the calcaneus and thus establishing a more stable position for the cuboid bone C. This is important as the cuboid C acts anatomically as a pulley around which the important peroneous longus tendon travels as it changes its direction and force vector on its way to the insertion into the plantar aspect of the base of the first metatarsal bone G.

The three basic segments 12, 14 and 16, and the various control posts optionally and selectively used therewith (as described hereinafter) are preferably formed of a light weight rigid material such as a transparent thermoplastic nitrile acrylic (available from Rohm of Darmstadt, W. Germany under the trade name ROHADUR), but may also be formed of 18 gauge steel, or a variety of other materials recognized as useful in the art. Alternatively the control posts may be formed of less rigid hard material such as methyl methacrylate or relatively hard rubber. The connectors 30, 32 are preferably formed of an acetyl resin (available from DuPont under the trade name Supertough Delrin), although similar high tensile strength, low hysteresis materials may also be used.

Figure 3:
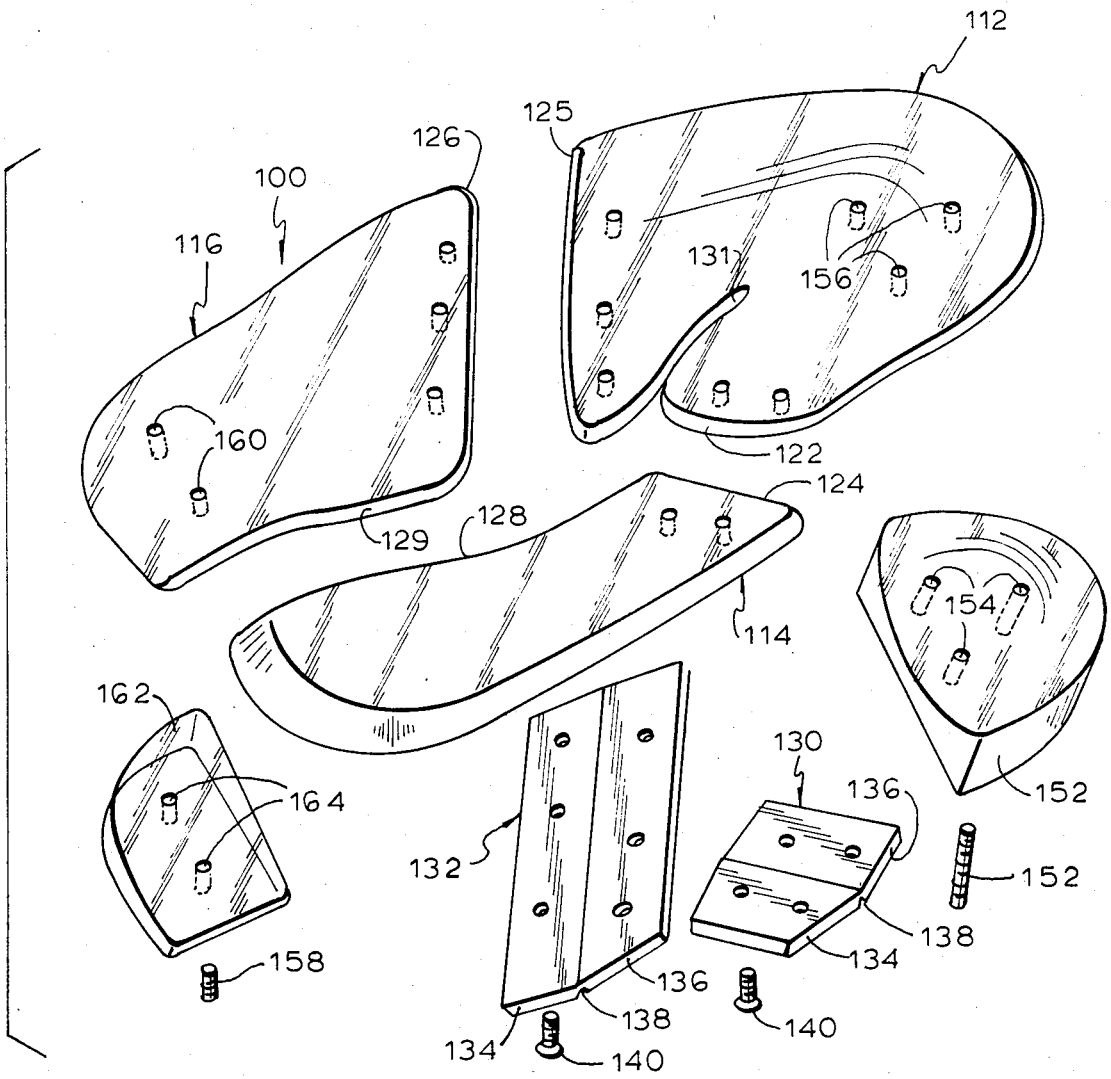
FIG. 3 is an exploded isometric view of a second embodiment of the present invention (a left foot orthosis)
Figure 4:
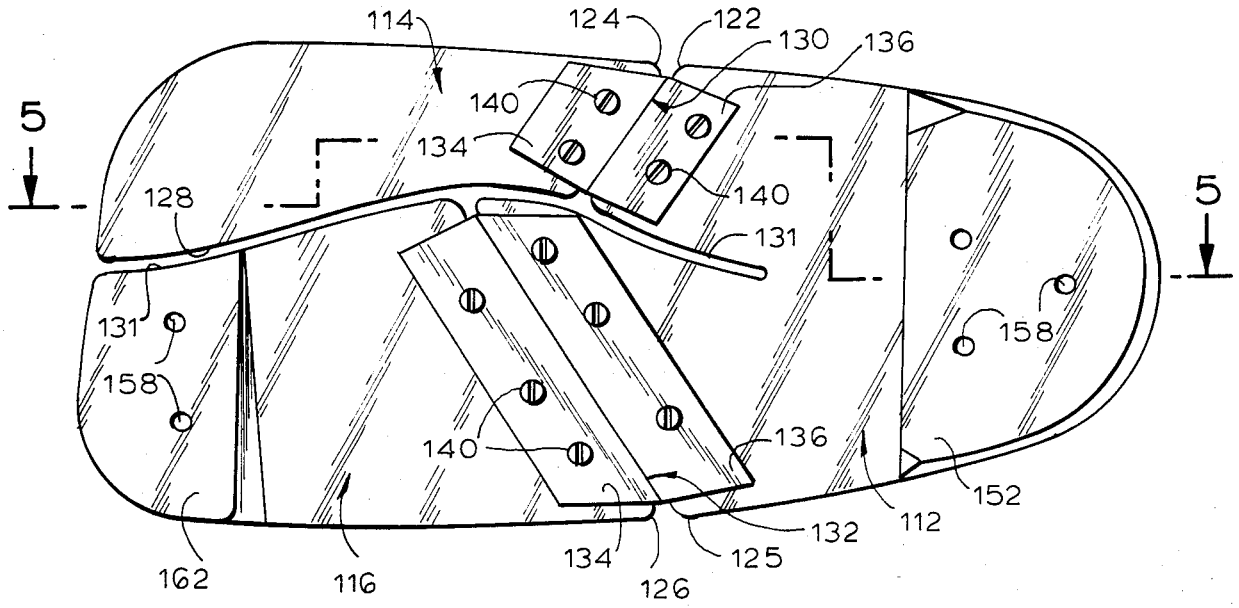
FIG. 4 is a bottom plan view of the second embodiment.
Figure 5:
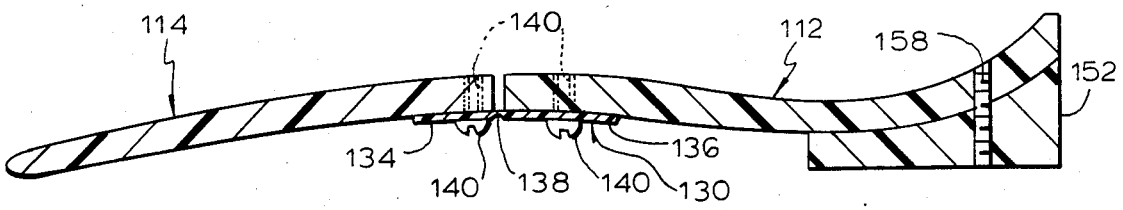
FIG. 5 is an elevation section view of the second embodiment, taken along the line 5—5 of FIG. 4.

Referring now to FIGS. 3–5, therein illustrated is a second embodiment 100 of the present invention. Elements of the second embodiment 100 which are functionally similar (though not necessarily identical) to elements of the first embodiment 10 have been given corresponding numerals in the 100 series. As in the first embodiment 10, the second embodiment 100 is comprised essentially of three substantially rigid segments: a heel segment 112, a lateral segment 114 and a medial segment 116.

Heel segment 112 of the second embodiment 100 is similar to heel segment 12 of the first embodiment 10 except that it lacks the built-in heel or lift on the plantar aspect. Instead the heel segment 112 of the second embodiment 100 is adapted to be used in conjunction with a heel control posting 152. The heel posting 152 and heel segment 112 may be secured together either permanently or removably, the latter affording obvious advantages in terms of modularity of design and adjustability. Accordingly, the heel posting 152 is provided with a triangular pattern of small holes 154 therethrough and the heel segment 112 is provided with a similar pattern of holes 156 therethrough so that tiny hexagonal screws 158 may be used to removably secure the heel posting 152 to the plantar aspect of the heel segment 112 once the holes 154, 156 have been aligned.

The medial segment 116 of the second embodiment 100 is similar to the medial segment 16 of the first embodiment 10 except that the distal end is provided with a pair of small holes 160 extending therethrough. This enables a medial control posting 162, having a similar pair of holes 164, to be secured to the planter aspect of the medial segment by hex screws 158.

The lateral segment 114 of the second embodiment 100 is similar to the lateral segment 14 of the first embodiment 10 except that it extends longitudinally as far distally as the medial segment 116. As earlier noted, it has been found that distal extension of the lateral segment beyond the midshaft of the fifth metatarsal E is generally unnecessary and may even be disadvantageous. If desired, for example in cases of Charot-Marie-Tooth disease, a lateral control posting (not shown) may be secured to the planter aspect of the distal end of the lateral segment 114 using hex screws in the manner indicated in connection with the other postings 152, 162.

The control posts 152, 162, as well as any others placed on the lateral segment 114, have dorsal faces configured and dimensioned to be readily received within shoes or other footwear. For example, the distal portion of the heel control post 152 has a dorsal aspect adapted to receive the plantar aspect of the heel segment 112 and a plantar aspect adapted to be received in a shoe. The control post may be secured to the segments by hex screws 158, as shown, or by other means of securing well known in the art. In all instances the dorsal aspects of the screws 40, 140 and hex screws 158 are sunk below the plantar aspect of the segment thereabout for the comfort of the wearer.

Thus the foot orthosis 100 may be provided with control posts which are added to particular components at particular sites and at certain angular positions so as to control, accelerate or decelerate subtalar joint pronation or supination and midtarsal joint longitudinal axis and oblique axis pronation or supination consistent with the degree of control required for specific pathological functional and structional entities or combinations of entities. Variations in the componential shapes, lengths and widths and additional modular design modifications all lend to the therapeutic versatility of the device.

The connectors 130, 132 of the second embodiment are similar to the connectors 30, 32 of the first embodiment except that they have no biasing function, the corrective function in effect being performed by the control posting. The connectors may be made, for example, of non-stretchable polypropylene or nylon. Of course, if desired for particular applications, the connectors 130, 132 may be made of the same material as the connectors 30, 32 so that the connectors and control posts both provide a corrective action.

Referring now to FIGS. 6 through 7, therein illustrated is a third embodiment 200. Elements of the third embodiment 200 which are functionally similar (in a general way) to elements described in connection with the first or second embodiments have been given corresponding numerals in the 200 series. As in the other embodiments 10, 100, the third embodiment 200 is comprised essentially of three substantially rigid segments: a heel segment 212, a lateral segment 214, and a medial segment 216.

The heel segment 212 of the third embodiment 200 is substantially similar to the heel segment 12 of the first embodiment 10 except for an upward extension of the lateral side of the heel segment 212. The medial segment 216 is similar to the medial segment 16 of the first embodiment except that the distal end thereof is inclined forwardly. The lateral segment 214 is similar to the lateral segment 14 of the second embodiment, but it extends further distally to form a gait plate, the distal end thereof continuing the taper of the distal end of the medial segment 216 to provide a generally smooth curve in the direction of the hallux. This arrangement is particularly suited for use in the treatment of children who need correction of a toe-in problem.

The connectors 230, 232 are substantially similar to the connectors 130, 132 of the second embodiment 100 in that they have no substantial function in biasing either the lateral or medial segments 214, 216, or both, relative to the general plane of the heel segment 212. Instead the function of biasing the lateral segment 214, and if desired the medial segment 216 as well, is performed by thin strips 270 of a structurally strong resilient material, such as a polyurethane derivative (available under the trade name Sorbothane) or a silicone (available under the tradename Sears Silicone Sealer). One thin strip 270 is disposed between the opposing faces 222 of the heel segment and 224 of the lateral segment, and another strip 270 between the opposing faces 225 of the heel segment and 226 of the medial segment. The strips 270 are optionally secured to both opposing faces 222 and 224 or 225 and 226 by adhesives, heat treatment, or whatever means may be appropriate for the particular material being used as the strip. The material selected for use in the strip 270 must be sufficiently resilient to bias the lateral and medial segments 214, 216 to pivot downwardly during pronation (as shown in FIG. 7A) and then permit the segments 214,

216 to pivot upwardly (as shown in FIG. 7) upon the application of downward pressure during supination, with a return to the original position upon release of the pressure. The strips are preferably of an inverted truncated triangular cross-section, the exact dimensions and configurations being selected to achieve particular degrees of bias.

If desired, the same resilient strip technique may be employed between the heel segment 212 and the lateral segment 214 only, or between the heel segment of one of the earlier embodiments and one or both of the other segments of the other embodiments. The strip may be used in connection with non-biasing connectors, such as connectors 230, 232 or with biasing connectors, such as connectors 30, 32. Indeed, where the strip is of sufficient structural strength and resiliency, a connector may be dispensed with and a strip 270 permitted to act as its functional equivalent for operatively connecting the heel segment to another segment and permitting limited pivoting of the other segment relative to the heel segment.

Figure 8:
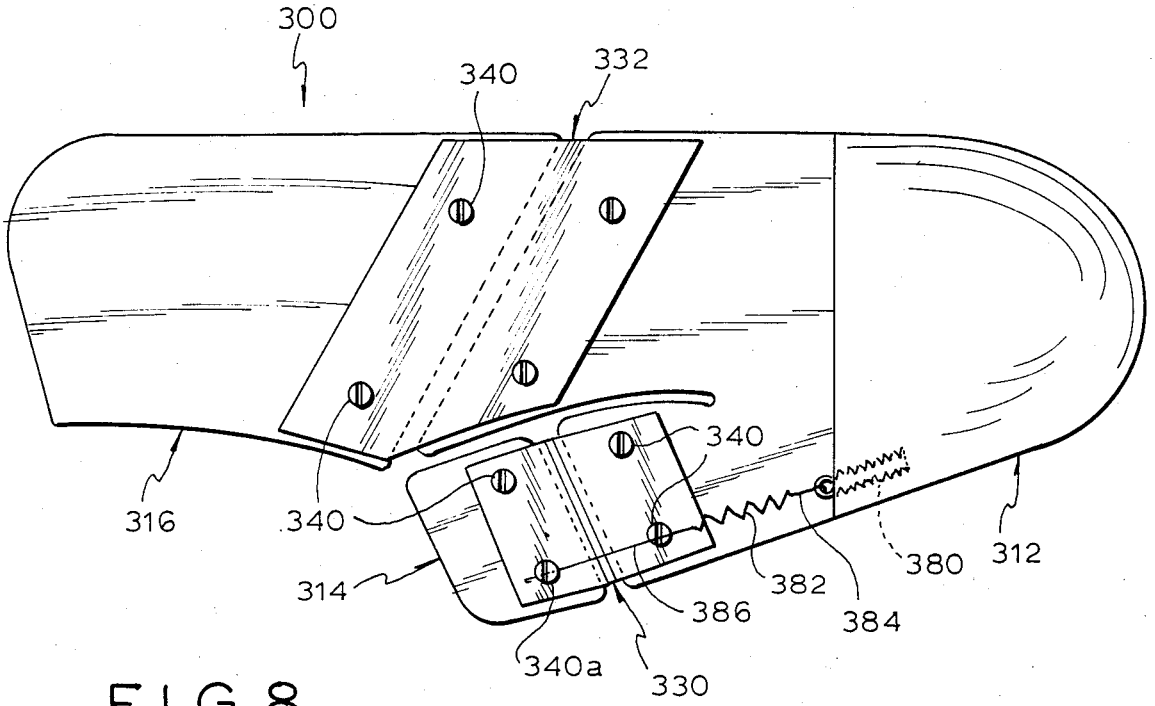
FIG. 8 is a bottom plan view of the fourth embodiment of the present invention (a right foot orthosis)
Figure 9:
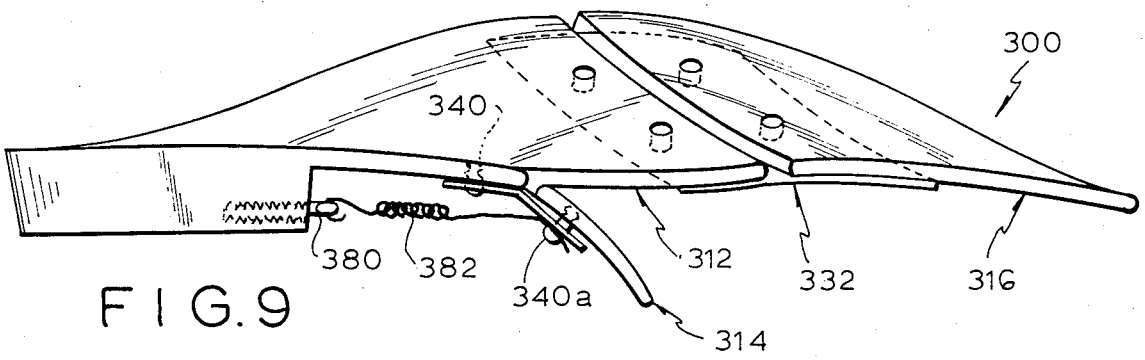
FIG. 9 is a side elevation view of the fourth embodiment, with the lateral hinge being shown unflexed.
Figure 10:
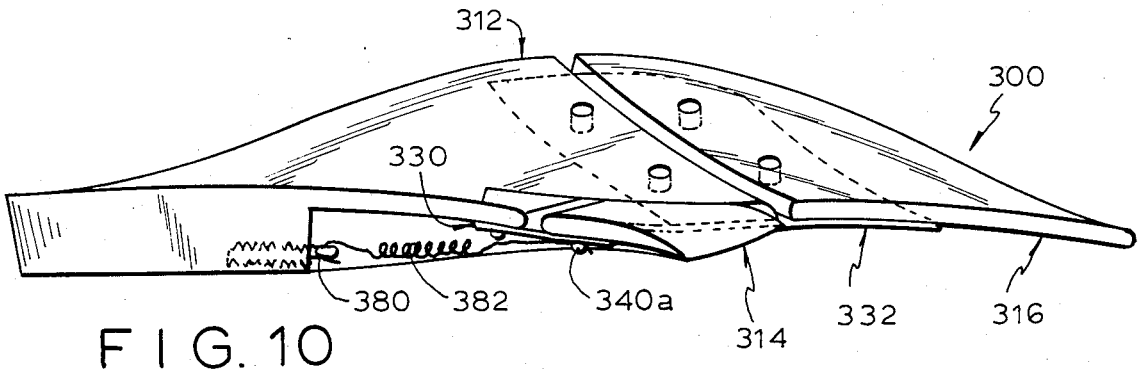
FIG. 10 is a side elevation view of the fourth embodiment, similar to FIG. 9, but with the lateral hinge flexed downwardly.

Referring now to FIGS. 8–10, therein illustrated is a fourth embodiment 300 of the present invention. Elements of the fourth embodiment 300 which are functionally similar to elements described in connection with one of the other embodiments have been given corresponding numerals in the 300 series. The fourth embodiment 300 is almost identical to the first embodiment 10 except that the connectors 330, 332 of the fourth embodiment are non-biasing, and biasing is provided for the lateral segment 314 by means of an anchor 380 and a coil spring 382. The threaded end of the anchor 380 is secured in the lower portion of the heel segment 312. (If a heel segment 112 and heel posting 152 were used, as in the second embodiment, the threaded end of the anchor ring would be received in the heel posting 152.) The coil spring 382 has a rear end 384 hooked on the ring end of the anchor 380 and a front end secured about the lateral screw 340A securing the connector 330 to the lateral segment 314. During pronation the extended expansion spring 382 will contract and cause the lateral segment 314 to pivot downwardly (as shown in FIG. 9). Then during supination the downward pressure exerted by the foot on the lateral segment 314 causes it to pivot upwardly, thereby extending the spring 382 beyond its normal length (as shown in FIG. 10). The degree of bias applied by the spring 382 may be adjusted by selection of an appropriate spring 382 (in terms of both strength and length) and by rotation of anchor 380 so as to increase or decrease the effective length of the spring/anchor combination. To prevent snagging of the shoe by the spring or interference by the shoe with functioning of the spring, the spring may be sealed in a cylinder with just the spring ends projecting therefrom.

The spring biasing technique illustrated in connection with the biasing of the lateral segment 314 is equally applicable to biasing of the medial segment 316 or indeed the medial and/or lateral segments of the other embodiments. It may be used by itself or in conjunction with other biasing techniques such as the resilient strip technique of the third embodiment 200 or the resilient connector technique of the first embodiment 10.

The action of the segmented triplanar orthopedic appliance of the present invention on an abnormally functioning foot is as follows:

With abnormal pronation of the subtalar joint the midtarsal joint remains pronated about the oblique axis. Since the subtalar joint remains pronated and, therefore, these tarsal bones are unlocked or unstable as heel lifts begins, the cuboid cannot be stabilized against the calcaneus. Therefore, as weight begins to travel more distally, the fourth and fifth rays or lateral column pronate via the oblique axis in an abductory and dorsiflexory movement. As the peroneous longus now begins to contract, however, the cuboid (which was rendered unstable) no longer functions as an effective stable pulley for the tendon of the peroneous longus muscle. Therefore, the effective plantarflexory force to the first ray is vastly decreased, weight now begins to transfer medially, and the entire first ray, which is now rendered completely unstable, dorsiflexes and inverts from the reactive force of gravity. Rather than an effective propulsion from the first ray, and ultimately through the hallux, the patient simply rolls off medially. This is not only a very inefficient means of propulsion, but one which can result in a whole host of forefoot problems—namely, hallus abductovalgus (bunion deformity), hammertoes or metatarsalgia, etc.

By utilizing the device of the present invention on such an abnormal foot and by posting the heel segment to instill a sagittal plantarflexory pitch to the distal aspect of the lateral segment, the cuboid can be effectively "locked" against the calcaneus. This combined with the ability of the distal aspect of the lateral segment to plantarflex (as by use of a biasing connector, a resilient strip or a spring) allows the forefoot to plantarflex and adduct about the oblique midtarsal joint axis after heel lift. This action results in an increased vertical pitch to the entire midtarsal joint of which the cuboid pulley is a component, thus vastly increasing the mechanical advantage of the peroneous longus tendon. This re-establishes the stability of the medial column of the foot in preparation for an effective act of propulsion from the hallux.

By componentially adjusting the plantar posts and the connectors, a patent can effectively be "fine-tuned" as their particular needs dictate. If, for example, the patient's symptomatology dictates a need for an increase in stability during the mid-stance or propulsive phases of gait, a slight adjustment to the connector would be made which would effectively "tighten" the cuboid against the calcaneus, further stabilizing the lateral column and also the medial column.

In the typical case where the lateral segment is biased (whether it be by the connector 40, the resilient strip 270 associated with the connector 240, or the spring 382) in order to effectively lock the cuboid against the calcaneous, thereby to increase the force and speed of resupination of the subtalor joint, essentially the same process occurs. At the time that the calcaneous contacts the ground (i.e., heel strike), the pronated or "loose" configuration of the foot enables the biasing means to pivot the distal end of the lateral segment downwardly below the level of the heel segment and against the common surface which it shares with the heel segment (typically the shoe sole) so that the distal end of the heel segment is slightly elevated. This effects a locking of the cuboid against the calcaneous, providing an effective cuboid pulley for the peroneous longus during resupination. After heel strike, as the weight is shifted forward and resupination commences, the rigidity of the foot and the forward displacement of the weight cause the lateral segment to pivot upwardly and flatten out (so that the heel segment and lateral segment are in the same general plane), the weight of the person on the foot being sufficient to overcome the effect of the biasing means.

Particular embodiments of the present invention are easily assemblable (with little more than a screwdriver being required) from a small supply of different heel segments, lateral segments and medial segments along with appropriate connectors and control posts. As each orthosis need no longer be created "from scratch" for each patient, the total costs for the orthosis are greatly reduced, thereby making them more widely available.

The entire orthosis may be provided with a vinyl cover, thereby to insure that, especially in the first, second and fourth embodiments, the skin of the plantar aspect of the user's foot does not become caught intermediate thc opposing faces of the three substantially rigid segments.

Thus the orthosis of the present invention provides many advantages over the rigid one piece orthoses of the prior art. Its segmented nature enables independent or concurrent control over the medial and lateral columns of the foot. Its modularity allows a removable posting system to be applied to any of its segments and enables both the control posts and the segments to be pre-manufactured and selected according to the patient's particular needs, the components being substantially interchangeable. In appropriate embodiments, the connector or biasing means may be employed to prevent abnormal sagittal plane motion between the various segments or, in conjunction with traditional plantar control posts, to obtain additional control over either medial or lateral segments.

To summarize, the segmented triplanar orthopedic appliance of the present invention is capable of adjusting to and varying positions and activities of the human foot in a manner which maximizes the body's own muscular, neurologic and skeletal functions. It may mobilize, restrict or enhance certain motions by altering the angular relationships of the osseous structures of the feet which, together with phasic muscle activity, are responsible for the unlocking and locking (adaptive and propulsive) mechanisms in the feet. It is comprised of components modularly assemblable to meet the particular needs of a given patient and permits control of the degree of positional change in a sequential manner.

Now that the preferred embodiments of the present invention have been shown and described in detail, various modifications and improvements thereon will become readily apparent to those skilled in the art. For example, the biasing function may be taken over or supplemented by a hydraulic or pneumatic system providing a spring or biasing action. Accordingly the spirit and scope of the present invention is to be limited only by the appended claims, and not by the foregoing disclosure.

We claim:

1. A segmented triplanar orthopedic appliance for correctably realigning and repositioning specific anatomical segments of the human foot, comprising:

(a) a substantially rigid heel segment adapted to lie generally underneath the plantar aspect of the heel region of the foot;

(b) a substantially rigid medial segment adapted to extend longitudinally lengthwise of the foot and lie generally underneath the plantar aspect of at least the medial column of the foot;

(c) a substantially rigid lateral segment adapted to extend longitudinally lengthwise of the foot and lie generally underneath the plantar aspect of at least a portion of the lateral column of the foot;

(d) first substantially flexible means operatively connecting said heel segment and said medial segment; and (e) second substantially flexible means operatively connecting said heel segment and said lateral segment;

said connecting means permitting independent limited pivoting of said medial and lateral segments, respectively, relative to said heel segment, wherein said lateral segment is movable between first and second positions, said orthosis further comprising means for biasing said lateral segment from said second position towards said first position, said lateral segment in said first position acting on a common surface with said heel segment to reposition said heel segment for support of the cuboid and in said second position being disposed so as to not effect such repositioning of said heel segment, said lateral segment assuming said first position in response to said biasing means during pronation and said second position in response to and during supination.

2. The appliance of claim 1 wherein said connecting means are disposed on the plantar aspects of said segments.

3. The appliance of claim 1 further comprising means removably securing opposite ends of said connecting means to said heel segment, on the one hand, and one of said other segments, on the other hand.

4. The appliance of claim 1 wherein each of said connecting means comprises a pair of end portions foldable about a common crease therebetween.

5. The appliance of claim 1 further comprising posting means operatively mounted on the plantar aspect of said heel segment.

6. The appliance of claim 1 further comprising posting means operatively mounted on the plantar aspect of said lateral segment.

7. The appliance of claim 1 further comprising a resilient strip disposed between and secured to a pair of facing surfaces of said heel segment and one of said other segments, said strip being adapted to bias said heel segment and said other one segment into a predetermined relative relationship.

8. The appliance of claim 7 wherein said resilient strip is a polyurethane derivative.

9. The appliance of claim 7 wherein said strip is disposed between facing surfaces of said heel segment and said lateral segment.

10. The appliance of claim 1 wherein opposing faces of said medial and lateral segments are spaced from each other along a curve adapted to lie approximately parallel to and in a plane beneath the longitudinal axis of the midtarsal joint.

11. The appliance of claim 10 wherein said curve corresponds approximately to the curve extending between the third and fourth rays.

12. The appliance of claim 10 wherein said heel segment is notched along a curve approximately corresponding to the curve passing between the navicular and the cuboid, to the talus.

13. The appliance of claim 1 wherein opposing faces of said heel and lateral segments are spaced from each other along a plane adapted to pass through the cuboid parallel to the oblique axis of the midtarsal joint.

14. The appliance of claim 1 wherein opposing faces of said heel and medial segments are spaced from each other along a plane generally parallel to the axis of motion of the first ray.

15. The appliance of claim 1 where opposing faces of said medial and lateral segments are spaced from each other along a curve adapted to lie generally parallel to and in a plane beneath the longitudinal axis of the midtarsal joint, the opposing faces of said heel and lateral segments are spaced from each other along a plane adapted to pass through the cuboid parallel to the oblique axis of the midtarsal joint, and the opposing faces of said heel and medial segments are generally spaced from each other along a plane parallel to the axis of motion of the first ray.

16. The appliance of claim 15 wherein said heel segment is notched along a curve approximately corresponding to the curve passing between the navicular and the cuboid, to the talus.

17. The appliance of claim 1 wherein said heel segment is notched along a curve approximately corresponding to the curve passing between the navicular and the cuboid, to the talus.

18. The appliance of claim 1 further comprising an expansion spring having one end operatively secured to said heel segment and the other end operatively secured to one of said other segments, said spring being adapted to bias said one segment into a predetermined relationship with said heel segment.

19. The appliance of claim 18, wherein said spring other end biases said one other segment rearwardly, thereby causing said one segment to pivot downwardly.

20. The appliance of claim 18, wherein said one other segment is said lateral segment.

21. The appliance of claim 1 wherein said lateral segment extends only to the base of the metatarsals.

22. The appliance of claim 1 wherein said connecting means maintain the opposing surfaces of said heel segment, on the one hand, and said other segments, on the other hand, in sufficiently close proximity that said opposing surfaces by abutment limit relative movement of said heel segment and said other segments.

* * * * *